US005328173A

United States Patent [19]

Stern

[11] Patent Number: 5,328,173

[45] Date of Patent: Jul. 12, 1994

[54] DEVICE FOR THE RANDOM SELECTION OF LETTERS AND GAME UTILIZING SAME

[76] Inventor: Leon M. Stern, P.O. Box 1301, McAfee, N.J. 07428

[21] Appl. No.: 83,107

[22] Filed: Jun. 25, 1993

[51] Int. Cl.[5] ..... A63F 9/00

[52] U.S. Cl. ..... 273/144 B; 273/457; 273/459

[58] Field of Search ..... 273/144 B, 145 C, 145 CA, 273/144 R, 457, 272, 459

[56] References Cited

U.S. PATENT DOCUMENTS

| | | | |
|---|---|---|---|
| 1,538,455 | 5/1925 | Winkel | 273/145 C |
| 2,739,815 | 3/1956 | Fay | 273/145 C |
| 3,724,847 | 4/1973 | Compton | 273/145 C |
| 4,004,811 | 1/1977 | Brandin | 273/272 |
| 4,383,689 | 5/1983 | Kohner | 273/145 R |
| 4,444,394 | 4/1984 | Pasquine | 273/144 B |
| 4,509,758 | 4/1985 | Cole | 273/240 |
| 4,533,143 | 8/1985 | Albright | 273/144 B |
| 4,943,062 | 7/1990 | Gillette | 273/144 B |
| 5,039,101 | 8/1991 | Potter | 273/144 B |
| 5,050,882 | 9/1991 | Yang | 273/144 B |

*Primary Examiner*—Benjamin H. Layno

*Attorney, Agent, or Firm*—Anderson Kill Olick & Oshinsky

[57] ABSTRACT

A device for the random selection of letters, and a game utilizing same, is disclosed which comprises a container with at least a transparent top wall. The container has an inner cavity which is separated by a plate which has a plurality of holes therethrough. The plate separates the inner chamber into a lower chamber and an upper chamber. The inner chamber is filled with a fluid. A plurality of balls, which are filled with a solid or a liquid substance, or a gas, or air, which substance, gas or air has a lower specific gravity than the specific gravity of the fluid, are submerged in the fluid. The balls may have letters ascribed thereon, or they may be blank. When it is desired to randomly select a set of letters, the device is shaken and/or agitated and then placed in an upright position whereupon a ball will at least partially enter each of the holes in the plate thereby providing for a random selection of balls having letters or blanks. The randomly selected letters or blanks may be used in playing word and/or letter games. Various word and/or letter games which may be played with the device are also disclosed.

17 Claims, 3 Drawing Sheets

DEVICE FOR THE RANDOM SELECTION OF LETTERS AND GAME UTILIZING SAME

FIELD OF THE INVENTION

The present invention pertains to a device for the random selection of letters and a game utilizing same.

BACKGROUND OF THE INVENTION

Word games and/or letter games are known in the prior art wherein words may be formed from letters, or letter combinations may be made, from randomly selected letters. These word games and letter games are popular, come in many varieties and are enjoyed by children as well as by adults of any age and any intelligence level.

Some of the known prior art word games and letter games are played in conjunction with a game board or boards upon which loose individual game pieces or tiles, having letters printed thereon, may be placed and/or arranged. Games such as these may be restrictive as to the number of players allowed to participate in them. Further, these prior art games usually require a specific playing area, which is typically a flat surface, and usually requires room for the players to gather around the game.

Such games also require the use of loose individual game pieces, which may be relatively small and which may require a direct manual handling and mixing of the these game pieces. In this regard, these prior art games require a sufficient amount of playing room as well as care so as not to lose the game pieces. Where small children are involved, it is also undesirable to have loose game pieces within their reach as they could be injured by swallowing these loose game pieces. In this manner, some of these prior art games may be unsafe for use in the vicinity of small children.

Word games and/or letter games are also known which utilize devices which have mechanical parts. In these games, these mechanical parts may malfunction, which many render the game devices unusable.

The present invention overcomes the drawbacks and disadvantages which are associated with the prior art word games and/or letter games.

SUMMARY OF THE INVENTION

The present invention provides for a device for the random selection of letters and to a game utilizing same, which overcomes the shortcomings of the prior art word and/or letter games.

The device of the present invention may take the form of a rectangular container which has a front wall, a back wall and side walls. The device also has a bottom wall and a top wall. Of the above walls, at least the top wall must be transparent. While the device is described as having a rectangular shape, it is important to note that the device may be of a cylindrical shape or of any other shape which is suitable for, and which is consistent with, the use and functioning of the device. While the device of the present invention is typically of a hand-held size, the device may be of any size.

The device has an inner chamber which is hollow and which is partially filled with a fluid. The container of the device must be water-tight as well as air-tight. The container must be water-tight so as to prevent the escape of the fluid from the device as well as being air-tight so as to prevent any evaporation of the fluid.

The device also comprises a display plate, which is located within the inner chamber and which is located at a location somewhat closer to the top end wall. The display plate serves to divide the inner chamber into a lower chamber and an upper chamber. The display plate also has a plurality of circular holes therein which holes facilitate the selection of the random letters. The plate is also utilized so as to define the height of the fluid which is to be filled into the device. In this manner, the level of the fluid should coincide with the location of the plate.

A plurality of balls are located in the lower chamber and are submerged in the fluid. While most of the balls have letters ascribed thereon, some of the balls may also be blank. The ascribed balls may have a letter ascribed thereon in a multitude of locations around the ball so that the letter may be discernable from any viewing point. The balls may be hollow or may be solid and may be either filled with a substance, a gas, or air, which must have a lower specific gravity than the specific gravity of the fluid. This will facilitate the floating of these balls to the top of the fluid when the device is placed upright. The size of the balls must be slightly larger than the radius of the holes in the plate so as to keep the balls within the lower chamber. The device may also be capable of being opened, so as to replace the balls, if they should become water-logged or damaged, or so as to replace the fluid, if necessary.

When the device is rotated or agitated, the fluid may freely flow through the holes in the plate and enter into the upper chamber. Due to the fact that the size of the balls are slightly larger than the holes of the plate, the balls will remain in the lower chamber. The free flow of fluid between the upper chamber and the lower chamber provides a means by which to agitate the balls and to facilitate their random movement about the fluid in the lower chamber.

When a selection of a random set of letters is desired, a user simply rotates, shakes or agitates the device. This may or may not include actually turning the device upside-down. After a sufficient amount of shaking and/or agitation has been performed, the user or player places the device in the upright position.

While in the upright position, the balls will float toward the surface of the fluid thereby causing a ball to enter each of the holes in the plate. Since the balls are marked with letters in multiple locations, the letter ascribed thereon may be easily discerned by viewing the plate through the transparent top wall.

Since the balls have a size which is slightly larger than the holes of the plate, they will not enter into the upper chamber, but rather, they will be partially retained within the holes of the plate. The device may need to be further agitated slightly so as to ensure that a ball enters into each of the holes.

The user(s) or player(s) may then utilize the randomly selected letters such as in the course of a game. When it is desired to obtain a new set of letters, the user or player may simply repeat the above process. The device of the present invention provides for the random selection of letters on a continuing basis and may be utilized in a wide variety of word and/or letter games.

The device may be used to play games which have the object of forming as many words and/or letter combinations as possible, within a given time period, by utilizing the randomly selected letters. The game of the present invention may be played by a solitary player or by a group of players. Further, the fact that the device may be portable, self-contained and hand-held, and require no special playing surface or area, allows for the device to be utilized in games which may be played anywhere and by any number of players.

The game of the present invention, in addition to comprising the device, should also comprise a game pad, a score pad, writing instrument(s) and a timer. The quantity of each letter utilized may be specifically determined in order to provide for an appropriate mix of vowels and consonants which may allow for maximum word and/or letter combination formation for the given number of balls utilized in the device. Blank balls may also be utilized which may be given special significance, or no significance, in the game. In this regard, a blank could be a "joker" or a "wild card letter" which could be used to represent any letter in a word or words or it may not be utilized in forming words.

An object of the game may be to make as many words and/or letter combinations from the selected letters as possible. If played by a solitary player, the game may have the objective of forming as many words and/or letter combinations as possible and/or creating the longest word and/or letter combination. Scoring and point values may be chosen depending upon the type of word and/or letter game played.

If played by a group of players, the object of the game may be to be the first player to achieve a predetermined score or to be the player with the highest score after a pre-determined interval. Scoring and point values may be chosen depending upon the type of word and/or letter game played.

The games which may be played by utilizing this device may be governed by any appropriate guidelines and/or rules.

As noted above, the device may be of a hand-held size, or it may be large enough to be utilized in front of an audience, such as in a television game show, or at public events such as carnivals or fairs, where players, or teams of players, may participate. Audience participation may or may not be permitted.

The device of the present invention provides for a self-contained hand-held game device which requires a minimal playing area and playing surface and which has no small and/or loose game pieces which may be lost or misplaced, or which may be hazardous to small children. There are no mechanical parts which could break or malfunction.

The game of the present invention provides for an enjoyable and a competitive word game which can be played and enjoyed by all age groups. The device and the game are highly portable and are ideal for travel and for use and enjoyment in any location or situation. The device and game require no large or specific playing surface or playing area which also makes it adaptable for various locations. The present invention has no limits as to the number of players which may play the game. The game may also be played in front of an audience with or without audience participation.

Accordingly, it is an object of the present invention to provide a device for the random selection of letters which is self-contained and which requires a minimal playing area and/or surface.

It is another object of the present invention to provide a device for the random selection of letters which has no small and/or loose game pieces.

It is another object of the present invention to provide a device for the random selection of letters which requires no mechanical parts.

It is still another object of the present invention to provide a word and/or letter game which has no small or loose game pieces.

It is still another object of the present invention to provide a word and/or letter game which requires no mechanical parts.

It is yet another object of the present invention to provide a word and/or letter game, which is competitive and which may be enjoyed by all age groups.

It is yet another object of the present invention to provide a word and/or letter game which requires no specific playing area and/or surface and which is adaptable for use at any location.

It is yet another object of the present invention to provide a game which is highly portable and which is ideal for travel.

It is still another object of the present invention to provide a word and/or letter game which may be played by a solitary player, a group of players and/or with audience participation.

Other objects and advantages of the present invention will be made apparent to those persons skilled in the art upon a review of the Detailed Description of the Preferred Embodiment taken in conjunction with the drawings which follow.

DETAILED DESCRIPTION OF THE PREFERRED EMBODIMENT

Figure 1:
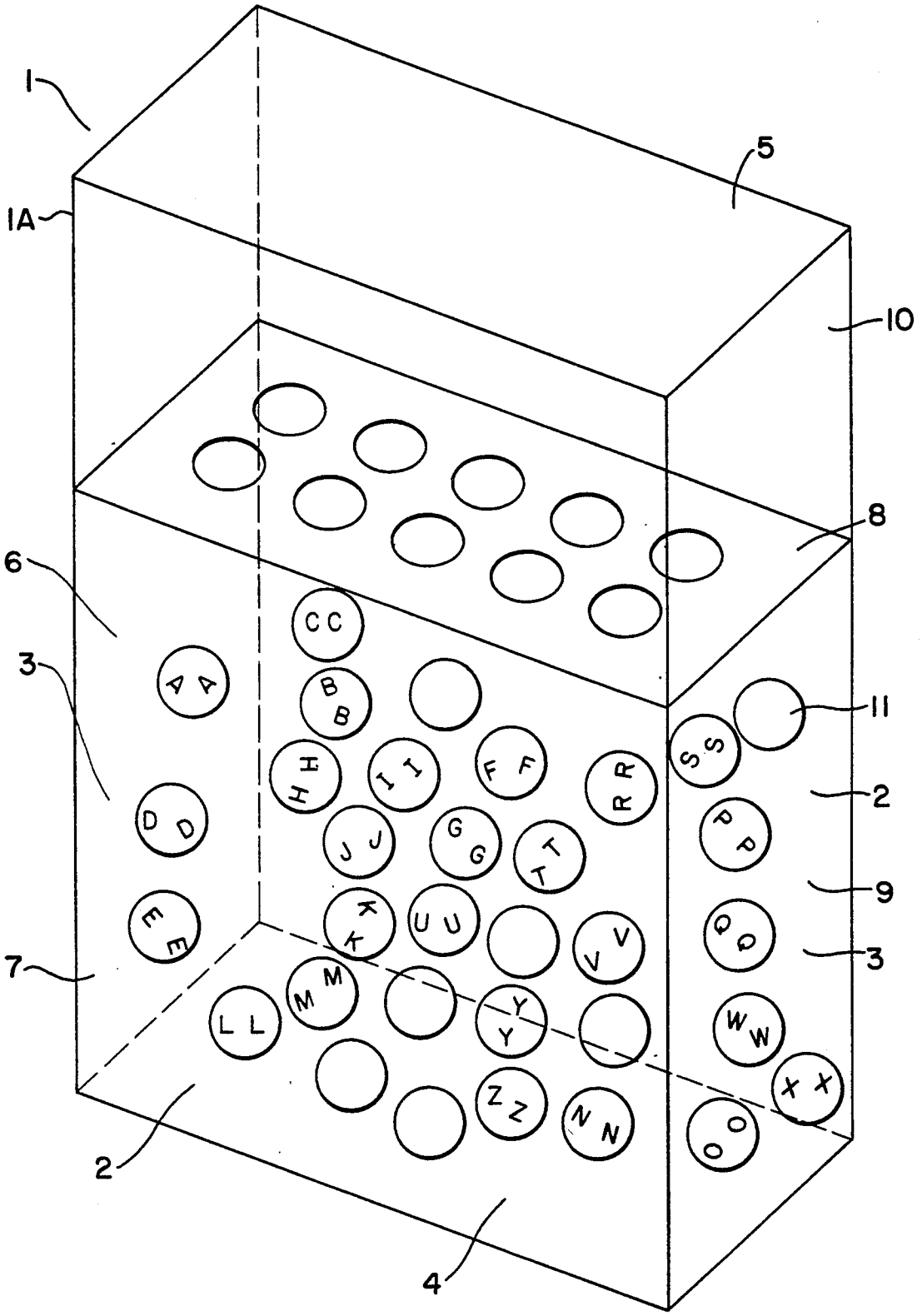
FIG. 1 illustrates the device which is the subject of the present invention which is shown in a 3-D perspective view.

FIG. 1 illustrates the device of the present invention, which is designated generally by the reference numeral 1, in a 3-D perspective view. The device 1 is illustrated in FIG. 1 in an upright position. The device 1, as illustrated in FIG. 1, is a rectangular container 1A having front and back walls 2 and side walls 3. The device 1 also has a bottom wall 4 and a top wall 5. Of the above walls of the rectangular container 1A, at least the top wall 5 must be transparent. While the device 1, in the preferred embodiment, is illustrated and described as having a rectangular shape, it is important to note that the device 1 may be of a cylindrical shape, or may be of any other shape which is suitable for, and which is consistent with, the use and functioning of the device 1 as will be described below. While a device 1, which is of a hand-held size, is desired in the preferred embodiment, the device 1 may be of any size and may be large enough to be used before an audience.

Referring once again to FIG. 1, the device 1, has an inner chamber 6 which is hollow and which is partially filled with a fluid 7. In this regard, it is important to note that the container of the device 1 must be water-tight as well as air-tight. The container 1A must be water-tight so as to prevent the escape of the fluid 7 from the device 1 as well as being air-tight so as to prevent any evaporation of the fluid 7.

Figure 2:
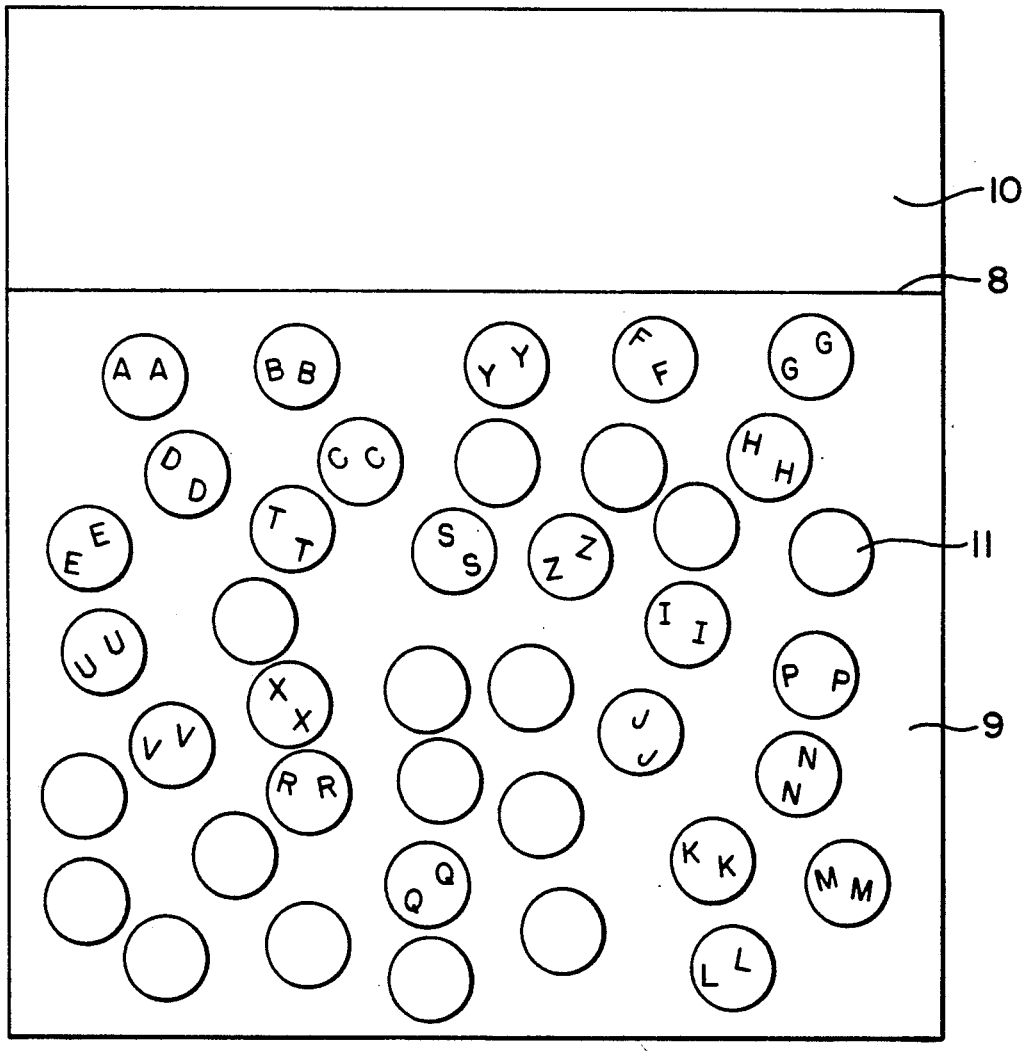
FIG. 2 illustrates a side view of the device of FIG. 1.
Figure 3:
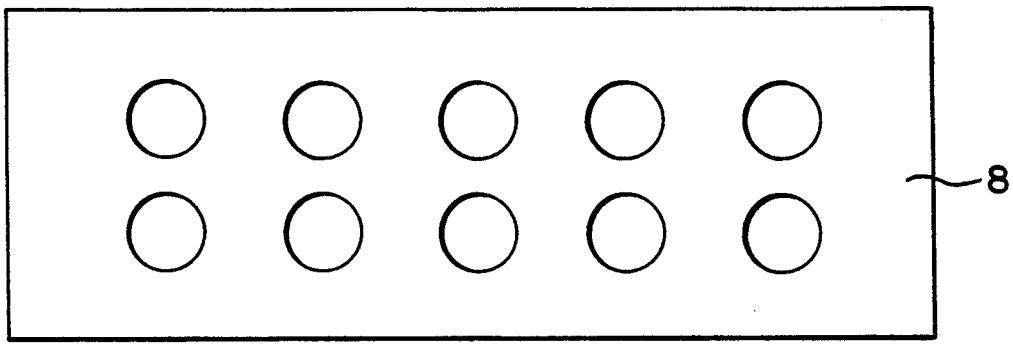
FIG. 3 illustrates a top view of the device of FIGS. 1 and 2.

The device 1 also comprises a display plate 8 which is located within the inner chamber 6 and which is located at a location closer to the top end wall 5. The display plate 6 serves to divide the inner chamber 6 into a lower chamber 9 and an upper chamber 10. The display plate 8 has a plurality of circular holes therethrough which holes facilitate the selection of the random letters in the manner which will be described below. FIG. 2 illustrates a side view of the device 1. FIG. 3 illustrates a top view of the device 1. As shown in FIG. 3, the plate 8 contains 10 holes. The plate 8 is also utilized to define the height of the fluid 7 which is to be filled into the device 1. In this manner, the level of the fluid 7 should coincide with the location of the plate 8.

A plurality of balls 11 are located in the fluid 7. In the preferred embodiment, 79 balls 11 are utilized. While most of the balls 11 have letters ascribed thereon, some of them may also be blank. In the preferred embodiment, each of the balls 11, which have a letter ascribed thereon, have letters placed on a multitude of locations around the ball so that the letter may be discernable from any viewing point. The balls 11 may be hollow or may be solid and may be filled with a solid or a liquid substance, a gas, or air, which substance, gas or air, must have a lower specific gravity than the specific gravity of the fluid 7. This will facilitate the floating of these balls 11 to the top of the fluid 7 when the device 1 is placed in an upright position. The size of the balls 11 must be slightly larger than the radius of the holes in the plate 8 so as to keep the balls within the lower chamber. In a preferred embodiment, the balls 11 may be miniature ping-pong balls.

When the device is not in an upright position, the fluid 7 may freely flow through the holes in the plate 8 and enter into the upper chamber 10. Due to the fact that the size of the balls are slightly larger than the holes of the plate 8, the balls 11 will be partially retained within the holes and within the lower chamber 9. The free flow of fluid 7 between the upper chamber 10 and the lower chamber 9 provides a means by which to facilitate the random movement of the balls 11 about the lower chamber 9 which will further facilitate the mixing of the balls within the chamber. The device 1 may also be capable of being opened so as to replace the balls 11, if they should become water-logged or damaged, or so as to replace the fluid 7.

When a selection of a random set of letters is desired, a user or player simply shakes and/or agitates the device 1. After a sufficient amount of shaking and/or agitation has been performed, the user or player places the device in the upright position as shown in FIG. 1.

When the device is in the upright position, the balls 11 will float to the surface of the fluid 7 so that a ball 11 will enter each of the holes in the plate 8. Since the balls 11 are marked with letters in multiple locations, the user, player or other individual may discern the letter on each ball by viewing the top of the plate 8 through the transparent top wall 5. In this manner, 10 randomly picked balls having letters or blanks may be obtained.

Figure 4:
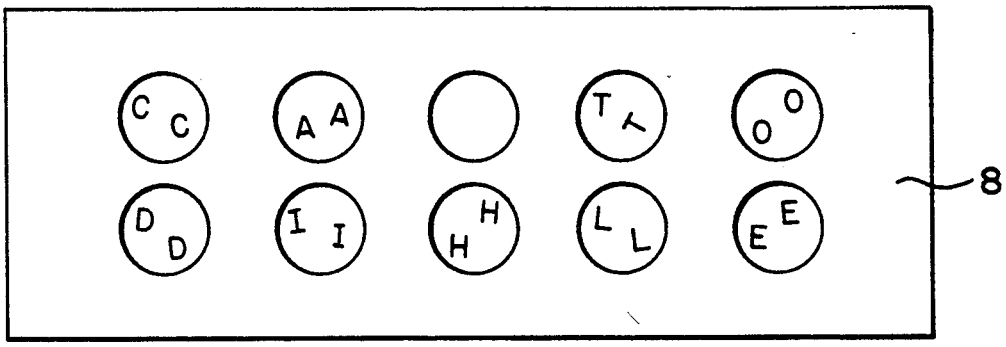
FIG. 4 illustrates a top view of the device of FIGS. 1, 2 and 3 illustrating how the randomly selected letters are displayed to a user or player.

FIG. 4 illustrates a top view of the plate 8 of the device 1 after the balls 11 having letters or blanks thereon, have been randomly selected. Since the balls 11 have a size which is slightly larger than the holes or the plate 8, the balls 11 will not enter the upper chamber 10, but rather will be restrained by, and partially received within, the holes in the plate 8. A continued shaking or agitation of the device 1 may be required in order to have a ball 11 received in each of the 10 holes.

The user(s) or player(s) may then utilize the randomly selected letters in order to play the word and/or letter game. When it is desired to obtain a new set of randomly selected letters, the user(s) or player(s) simply repeat the above procedure. The device 1 of the present invention provides for the random selection of letters on a continuing basis and may be utilized in a wide variety of word and/or letter games.

Examples of games with which the device of the present invention may be played, in a preferred embodiment, are described as follows. These games have the object of forming as many words as possible within a pre-determined time period by utilizing the letters which are randomly selected by the device 1.

The games may be played by a solitary player or by a group of players. Further, the fact that the device is portable and self-contained, thereby requiring no special playing area and/or surface, allows for the game to be played by any number of players at any location.

The game of the present invention, in addition to requiring the device 1, should also comprise a game pad, a score pad, writing instrument(s) and a timer. The timer may be a small mechanical or electrical timer and may be an hour glass filled with sand. As noted above, in the preferred embodiment, 79 balls are utilized in the device 1. Of these 79 balls, 77 are lettered and 2 are blank. In order to provide for an appropriate mix of vowels and consonants so as to allow for a random selection of letters, while allowing for maximum word formation from the number of balls utilized, the number of each letter used in the device may be as follows:

| Letter | Number of Balls Containing This Letter |
|---|---|
| A | 6 |
| B | 2 |
| C | 2 |
| D | 3 |
| E | 10 |
| F | 2 |
| G | 2 |
| H | 2 |
| I | 6 |
| J | 1 |
| K | 1 |
| L | 3 |
| M | 2 |
| N | 4 |
| O | 4 |
| P | 2 |
| Q | 1 |
| R | 4 |
| S | 4 |
| T | 4 |
| U | 3 |
| V | 2 |
| W | 2 |
| X | 1 |
| Y | 2 |
| Z | 2 |
| TOTAL NUMBER LETTERED BALLS | 77 |

As noted above, the blank balls which may be utilized, may be given special significance, or no significance, in the game. In the preferred embodiment, a blank could be a "joker" or a "wild card letter" which could represent any letter in a word or words or it may not be utilized in forming words.

SOLITARY PLAYER EMBODIMENT

If played by a solitary player, the game may be played in the following manner:

1. The player shakes and/or agitates the device 1, such as by turning it upside down, and if necessary, by a continued shaking and/or agitation, until 10 balls enter the 10 holes (one ball for each hole). The player then writes the letters down.

2. Once the letters or blanks are obtained, a timer is started and the player must attempt to form as many words as possible from the letters.

3. Blanks which are obtained for blank balls are "jokers" or "wild card letters" and can be used to represent any letter.

4. Slang and/or foreign words and/or proper names receive no points.

5. A point value is allocated for each word formed depending upon the number of letters contained in that word. The more letters utilized in a word, the higher the score.

6. The solitary player then tries to better his or her present score by each subsequent score obtained by a next random letter selection.

MULTIPLAYER EMBODIMENT #1

If played by a group of players, the game may be played as follows:

1. The player, whose turn it is pick the letters, shakes and/or agitates the device 1, such as by turning it upside down, and, if necessary, by a continued shaking and/or agitation, until 10 balls enter the 10 holes (one ball for each hole). The letters or blanks are then written down on a game pad.

2. Once the letters, or blanks are obtained, a timer is started whereupon each of the players must attempt to form as many words as possible from the letters.

3. Blanks which are obtained from blank balls are "jokers" or "wild card letters" and can be used to represent any letter.

4. Words must have a minimum of three (3) letters.

5. Upon the completion of the time period, the players, or a judge, must determine how many points each player has earned by the above word formation exercise. Scoring may be by each of the following guidelines or rules or by any combination thereof.

6. For each word formed from fewer than 10 letters the player gets 1 point.

7. For each word formed from all 10 letters the player gets 6 points.

8. The number of points the player gets may also equal the total number of letters in all of the formed words.

9. Slang and/or foreign words and/or proper names receive no points.

10. The first player to reach a score of 21 points wins the game.

11. If the player wishes, he or she may pass his or her turn to pick the letters or to form words therefrom.

MULTIPLAYER EMBODIMENT #2

1. The judge or non-player shakes and/or agitates the device 1, such as by turning it upside down, and if necessary, by a continued shaking and/or agitation, until 10 balls enter the 10 holes (one ball for each hole). The players then write the letters down.

2. Once the letters or blanks are obtained, a timer is started and the players must attempt to form as many words as possible from the letters.

3. Blanks which are obtained from blank balls are "jokers" or "wild card letters" and can be used to represent any letter.

4. Words must have a minimum of three (3) letters.

5. Upon the completion of the time period, the player, the players, or the judge or non-player, must determine how many points each of the players has earned by the above word formation exercise.

6. For each word formed from all 10 letters the player gets 6 points.

7. The number of points each player gets may also be equal to the number of letters in all of the formed words.

9. Slang and/or foreign words and/or proper names receive no points.

10. The first player to reach a score of 21 points wins the game.

11. If the player wishes, he or she may pass his or her turn to pick the letters or to form words therefrom.

While the device 1 has been described as being of a hand-held size, it is important to note that the device 1 may come in any size and may be large enough to be utilized in front of an audience, such as in a television game show, or at public events such as carnivals and/or fairs, where players, or teams of players may participate. Audience participation may also be allowed.

While several game embodiments have been described, it is important to note that any variety of games may be played with the device of the present invention. In this regard, it is possible to modify the game rules as to the number of players, the number of letters used, the quantity of each letter used, the allowed use or prohibited use of "joker" or "wild card letter" balls, the time period allowed for forming words, scoring methods, scores needed to win, and any other game objectives and/or guidelines or rules.

While the present invention has been described in a preferred embodiment such is merely illustrative of the present invention and is not to be construed as a limitation thereof. Accordingly, the present invention may include all modifications, variations and/or alternate embodiments with the scope of the present invention limited only by the claims which follow.

What is claimed is:

1. A device for the random selection of letters, which comprises:

a container which has a closed top end and a closed bottom end, wherein said container has an inner chamber, and further wherein said top end is transparent;

a plate which is located within said inner chamber and which divides said inner chamber into a lower chamber and an upper chamber, wherein said plate has a plurality of holes therethrough;

a fluid which is located within said inner chamber; and a plurality of balls which have letters thereon which are submerged in said fluid, wherein said balls are one of composed of and filled with one of a substance, gas and air which has a specific gravity which is lower than the specific gravity of said fluid, and further wherein said balls have a diameter which is larger than the diameter of each of said plurality of holes, and further wherein one of said balls partially enters each of said holes in said plate when said device is placed upright.

2. The device of claim 1, wherein said container is one of a rectangular, as square, a cylindrical and a circular shape.

3. The device of claim 1, wherein said container is of a hand-held size.

4. The device of claim 1, wherein said container is transparent.

5. The device of claim 1, wherein said fluid is water.

6. The device of claim 1, wherein said plurality of balls are filled with air.

7. The device of claim 1, wherein said plurality of balls have a same letter ascribed thereon in multiple locations.

8. The device of claim 1, wherein said plurality of balls includes blank balls.

9. A method for a word and/or letter game which is used in conjunction with the device of claim 1, which comprises the steps of:

one of shaking, agitating and inverting said device and placing said device in an upright position;

recording the set of randomly selected letters obtained by said one of shaking, agitating and inverting step;

forming as many one of words and letter combinations as possible from said set of letters;

assigning a score to said one of words and letter combinations formed from said set of letters; and determining whether a predetermined one of score and condition has been achieved.

10. A device for the random selection of letters, which comprises:

a container which has a closed top end and a closed bottom end, wherein said container has an inner chamber, and further wherein said top end is transparent;

a plate which is located within said inner chamber and which divides said inner chamber into a lower chamber and an upper chamber, wherein said plate has a plurality of holes therethrough;

a fluid which is located within said inner chamber wherein said fluid moves freely between said lower chamber and said upper chamber; and a plurality of balls which have a same letter thereon in multiple locations on each of said plurality of balls which are submerged in said fluid and which are located within said lower chamber, wherein said plurality of balls are one of composed of and filled with at least one of a substance, gas and air which has a specific gravity which is lower than the specific gravity of said fluid, and further wherein said balls have a diameter which is larger than the diameter of each of said plurality of holes, and further wherein said plurality of balls tend to float towards said plate when said device is placed upright, and further wherein one of said plurality of balls partially enters each of said holes in said plate when said device is placed upright.

11. The device of claim 10, wherein said container is at least one of a rectangular, a square, a cylindrical and a circular shape.

12. The device of claim 10, wherein said container is of a hand-held size.

13. The device of claim 10, wherein said container is transparent.

14. The device of claim 10, wherein said fluid is water.

15. The device of claim 10, wherein said plurality of balls are filled with air.

16. The device of claim 10, wherein said plurality of balls are composed of a plastic shell.

17. A method for a word and/or letter game which is used in conjunction with the device of claim 10, which comprises the steps of:

one of shaking, agitating and inverting said device and placing said device in an upright position;

recording the set of randomly selected letters obtained by said one of shaking, agitating and inverting step;

forming as many one of words and letter combinations as possible from said set of letters;

assigning a score to said one of words and letter combinations formed from said set of letters; and determining whether a predetermined one of score and condition has been achieved.

* * * * *